United States Patent [19]

Jones

[11] Patent Number: 4,821,346

[45] Date of Patent: Apr. 18, 1989

[54] TOILET BOWL CLEANING COMPOSITION DISPENSER

[76] Inventor: Gregory R. Jones, 4302 Greenlee Ave., Cincinnati, Ohio 45217

[21] Appl. No.: 4,351

[22] Filed: Jan. 15, 1987

[51] Int. Cl.[4] ..... E03D 9/02

[52] U.S. Cl. ..... 4/226

[58] Field of Search ..... 4/225, 226

[56] References Cited

U.S. PATENT DOCUMENTS

| | | | |
|---|---|---|---|
| 2,697,841 | 12/1954 | Collins | 4/228 |
| 2,761,151 | 9/1956 | Ferrando | 4/225 |
| 3,112,499 | 12/1983 | Thornton | 4/222 |
| 3,228,040 | 1/1966 | Currie | 4/226 |
| 3,290,698 | 12/1966 | Joyner et al. | 4/228 |
| 3,597,772 | 8/1971 | Leavitt | 4/222 |
| 3,911,507 | 10/1975 | Johnson | 4/244 |
| 4,142,260 | 3/1979 | Snyder | 4/223 |
| 4,229,410 | 10/1980 | Kosti | 422/28 |
| 4,467,480 | 8/1984 | Keller | 4/225 |
| 4,507,811 | 4/1985 | Beulow et al. | 4/225 |

FOREIGN PATENT DOCUMENTS 1014702 8/1977 Canada .

*Primary Examiner*—Charles E. Phillips

[57] ABSTRACT

A toilet cleaning solution dispenser adapted for placement in the overflow tube of a flush toilet includes an outer housing and an interior solution chamber in fluid communication, the dispensing of the solution being delayed until the closing of the bowl water refill valve.

17 Claims, 4 Drawing Sheets

TOILET BOWL CLEANING COMPOSITION DISPENSER

FIELD OF INVENTION

The subject device concerns a toilet bowl cleaning composition dispenser of the type containing a solid cleaning vehicle a portion of which is dissolved by the addition of water to the dispenser upon the occasion of a flush of the toilet. More specifically, the dispenser of the present invention is adapted for placement within the vertical overflow tube within the toilet tank and which is connected to the toilet bowl.

BACKGROUND OF THE INVENTION

Toilet cleaning compositions dispensers of the type for placement in the tank of a flush toilet are well represented in the prior art. In one embodiment the prior art dispenser comprises a substantially enclosed vessel for containing a solid cleaning vehicle and having at least one portal for water to enter and leave and usually a portal to vent air therefrom, the dispenser resting on the bottom of the tank or being suspended within the tank and from the rim thereof. Filling of the tank subsequent a flush similarly fills a portion of the vessel, the water therein dissolving a portion of the cleaner vehicle to form a concentrated cleaning solution which is released into the tank water on the occasion of the next flush of the toilet. Dispensers of this type may further include various passageways and interior compartments to isolate by forming an air lock the concentrated cleaning solution from the tank water during the quiescent period between flushes; to delay the release of the concentrated solution into the exiting tank water, or to control dissolution of the solid cleaning vehicle.

The disadvantage with such dispeners lies in the fact that the concentrated cleaning solution formed within the dispenser is discharged into at least a portion of the tank water and thus diluted before reaching the bowl. Moreover, typically greater than 70% of the tank water passes through the bowl and into the sewer, and any cleaning vehicle actives contained therein is wasted. Accordingly, these dispensers discharge into the tank water an amount of the concentrated cleaning solution in excess of that which is actually required for cleaning.

Most if not all toilets including a flush tank further include a vertical standpipe or overflow conduit within the tank and which is connected directly with the bowl. The overflow conduit is provided to add water to the bowl after the drain valve closes and in the event the tank water rises above a predetermined level. A number of prior art devices take advantage of the tube to dispense cleaning solution into the bowl. Thus, Can. Pat. No. 1,014,702 to Bush et al and U.S. Pat. No. 4,142,260 to Snyder disclose a device adapted for insertion within the standpipe comprising an elongated tube having an upper reservoir for containing a prepared cleaning solution and a lower air chamber, there being an apertured partition therebetween, the lower end of the chamber opposite the partition being open. That portion of the refill water diverted to the standpipe flow past the lower end of the device creating a vacuum within the air chamber thereby withdrawing a dosage amount of cleaning solution from the reservoir.

U.S. Pat. No. 4,467,480 to Keller discloses a standpipe residing dispenser comprising a lower reservoir for containing a solid cleaning vehicle having an apertured bottom and an upper chamber open at the top, there being an apertured partition between said lower reservoir and said upper chamber, the upper chamber including means to support the dispenser from the top of the standpipe. Water from the auxiliary tank refill line enters the upper chamber, which is rapidly flooded, excess overflowing and running off through the standpipe to the bowl. A portion of the water entering the upper chamber enters the lower chamber and dissolves by contact a portion of the solid cleaning vehicle therein, the aqueous solution of solid cleaning vehicle being dispensed continuously through the bottom aperture. When the auxiliary water flow stops, liquid contained in the upper chamber and the lower reservoir drain off. In an alternate embodiment shown in FIG. 7 of Keller, the lower reservoir has a sealed lower end and has side wall orifices proximate its top. Incoming water flows through an aperture in the partition between the upper chamber and the reservoir and mixes with residual concentrated cleaning solution in the reservoir, a thus diluted cleaning solution exiting by way of the side wall orifices.

U.S. Pat. No. 4,229,410 to Kosti discloses a toilet element having bacteriostatic and other activity that is retained within the drain connecting the tank and the bowl, the drain being defined as including an upright drain tube through which water passes during a flush only.

U.S. Pat. No. 2,697,841 to Collins concerns a standpipe insertible device comprising an elongate tube for containing a granular cleaning vehicle having a perforated lower end and an inlet tube proximate the top for connection by a rubber sleeve to the auxiliary water supply line. U.S. Pat. No. 3,911,507 to Collins concerns a dispenser mounted external the standpipe, the dispenser comprising a container, inlet and outlet ports and a regulator valve, the auxiliary water supply line being connected to the inlet port and the outlet port including a conduit leading to the standpipe. Water entering the container displaces a like amount of cleaning solution into the standpipe.

U.S. Pat. No. 2,761,151 to Ferrando discloses a device comprising a reservoir situated above the standpipe for containing a liquid cleaning composition; an upper chamber below the reservoir including a water inlet port; a lower chamber below the upper chamber, the partition between the chambers being apertured, and spring actuated valve means connecting the reservoir to the lower chamber, the weight of water in the lower chamber opening said valve means to dispense solution.

A disadvantage of prior art dispensers is that the cleaning vehicle solution is dispensed upon the onset of auxiliary water flow and continues throughout the period during which the flush valve is open. Thus, a portion of the cleaning solution passes through the bowl. Another disadvantage is that water entering the dispenser from the auxiliary water flow line has a temperature essentially that of the water supply source as measured at a point remote from the device, typically as it enters the residence of a consumer, where it quite often is dependent upon the ambient temperature conditions. This is most typically a problem in winter and summer when water temperature extremes would greatly vary cleaning vehicle solubility. Thus, in prior art dispensers controllability of the rate of dissolution of the solid cleaning vehicle is poor.

It is an object of the present invention to provide a dispenser that resides in the overflow tube or standpipe of a toilet tank and which dispenses a predetermined quantity of active cleaning solution into the bowl water.

It is a primary object of the present invention to dispense solution to the bowl from the dispenser subsequent to the closing of the water refill valve.

It is another object herein to provide greater control over the effects of water temperature on solubility of the solid cleaning vehicle.

These and other objects and advantages of the invention will be more fully understood upon inspection of the appended drawings and reading the detailed description provided herein, a summary of which follows.

SUMMARY OF THE INVENTION

The toilet bowl cleaning composition dispenser of the present invention is adapted for placement within an overflow tube of a flush toilet which tube connects the toilet tank with the toilet bowl and comprises an exterior housing having an essentially open top and an aperture proximate its bottom end; a cleaning composition solution chamber within the housing having a bottom and a vented top; a pathway providing fluid communication from the essentially open top of the housing to its apertured bottom end, said chamber having an aperture providing fluid communication between the chamber and the pathway, the chamber aperture being provided as to allow for the formation within the chamber of a dosage amount of cleaning composition solution, and means to retain the device within the overflow conduit. The solution chamber contains a solid cleaning vehicle characterized by a solubility providing gradual dissolution in water as may be added to the solution chamber during the flush cycle of the toilet. Water enters the housing from the auxiliary water line and fills the solution chamber through the aperture therethrough. Cleaning solution remains essentially isolated within the solution chamber until the auxiliary water flow ends and the water contained in the pathway begins to drop toward a level proximate to the height of the solution chamber aperture.

DESCRIPTION OF THE PREFERRED EMBODIMENT

Figure 1:
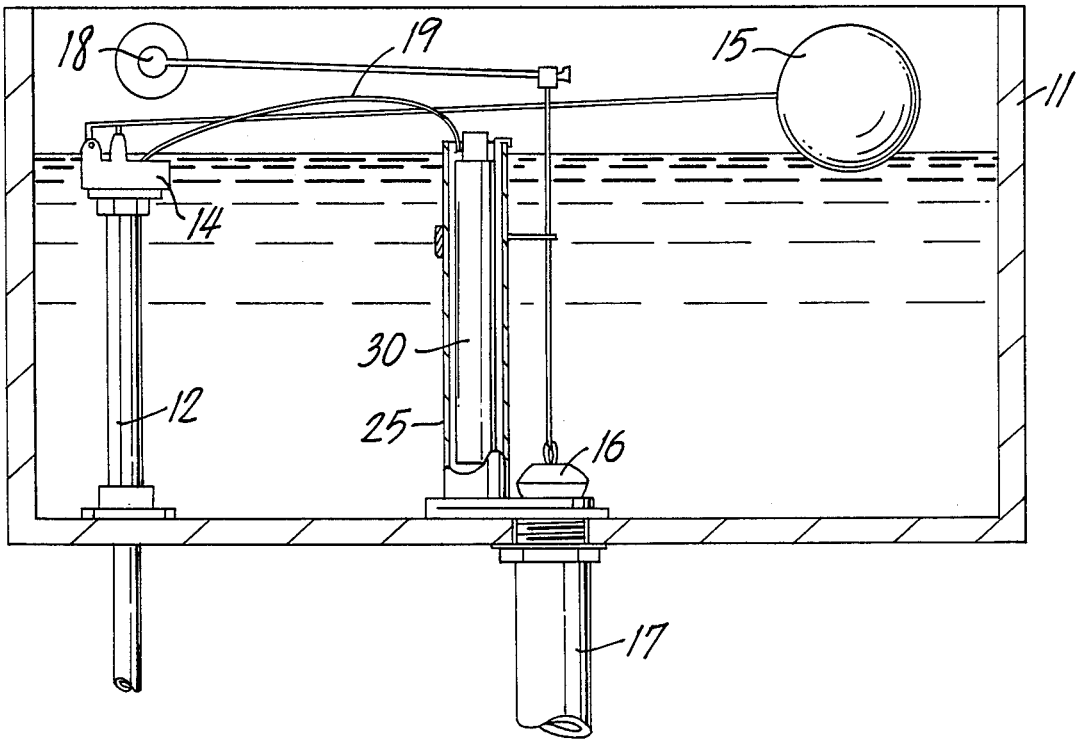
FIG. 1 is a cutaway view of a toilet tank illustrating the device of the present invention installed within an overflow tube.

Referring to FIG. 1, the dispenser 30 is shown in a cutaway portion of a standpipe or overflow tube 25 of a flush tank 11. The tank 11 includes water inlet pipe 12, valve 14 actuated by float 15, ball valve 16 overlying tank drain 17 and actuated by handle 18, and auxiliary water line 19, which is also actuated by float 15 and which directs a portion of water from pipe 12 to the overflow tube 25. Overflow tube 25 is in fluid communication with the toilet (not shown) through drain 17. Valve 14 is closed during the quiescent period between flushes and when the float 15 is a predetermined distance above the bottom of the tank 11. When the tank 11 is flushed, the float 15 falls and the valve 14 opens commencing the flow of tank inlet water, whose flow rate is less than flow of tank water through drain 17. A minor portion of the water inlet is directed to the overflow tube 25. When the liquid level has fallen to proximate the bottom of tank 11, ball valve 16 reseats and the tank 11 refills, water inlet terminating when the float reaches the predetermined level. As the tank refills, water entering the overflow pipe continues to flow into the bowl, to fill same to a predetermined level.

Nineteen toilets representing at least seven manufacturers were studied as to their flush and refill characteristics. Among the units tested there was wide variation in flush time, tank refill time and bowl refill time. Thus, flush time (i.e., the time for the tank to empty) varied from 7.5 to 15 seconds; the tank refill time varied from 49 to 240 seconds, and the bowl refill time varied from 16 to 90 seconds. It is seen that water flows through the overflow tube for a period of time equal to the flush time plus the tank refill time (the valve 14 open period). It is also seen that water entering the bowl from the overflow tube essentially passes through the bowl to the disposal system during the flush time period and displaces water from the bowl after the bowl has refilled and until the tank water inlet flow ceases. It is further seen that the valve open period less the bowl refill period, which ranged from 7.5 to 238 seconds in the units investigated, can be substantial. By providing an overflow tube dispenser that dispenses cleaning solution subsequent to valve 14 open period, essentially 100% of the dispensed solution would be retained in the bowl water.

Figure 2:
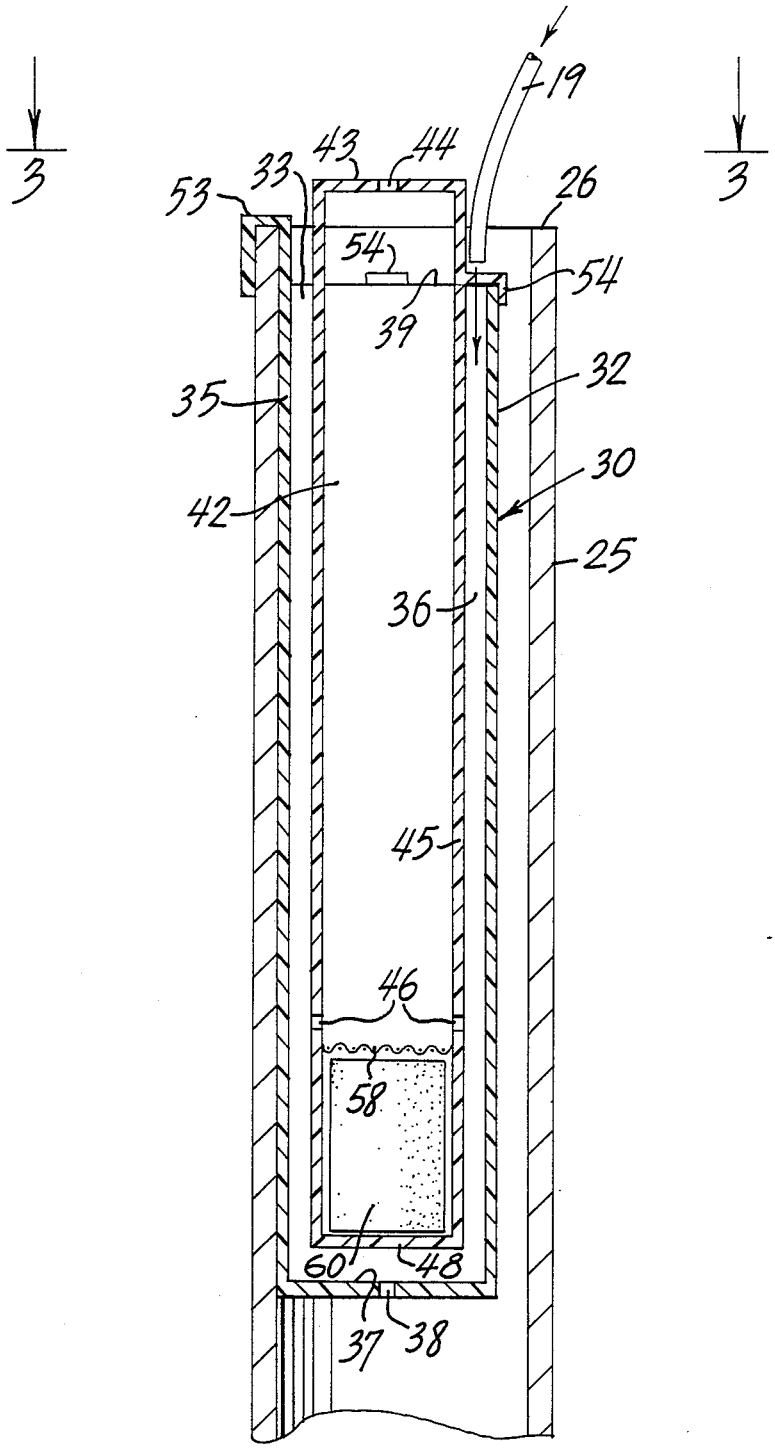
FIG. 2 is a half-sectional view of the device as same is installed within the overflow tube.

FIG. 2 is a half-section view of the subject dispenser 30 residing in a cutaway portion of the overflow tube 25. The dispenser 30 comprises an exterior housing 32, a cleaning composition solution chamber 42 disposed within the housing 32, and mounting means 53 for affixing the dispenser 30 to the edge 26 of the overflow tube 25. As shown in FIG. 2, the dispenser 30 is cylindrical in configuration, although any shape is suitable.

Figure 3:
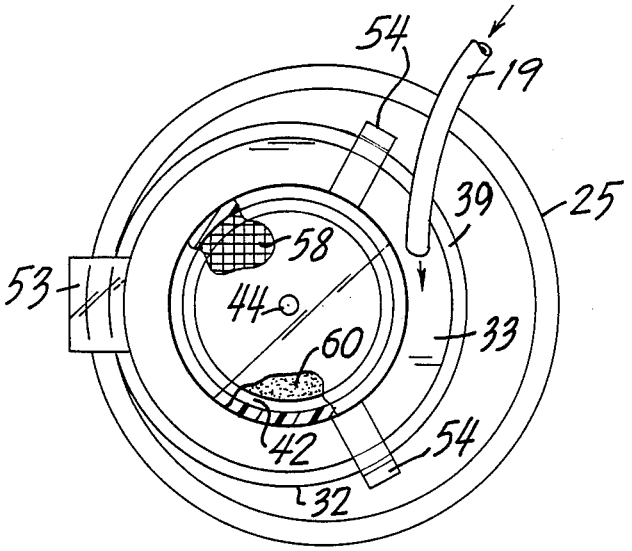
FIG. 3 is a cross-section view of the device taken along the line 3—3 of FIG. 2.

The housing 32 has an open top 33, a side wall 35, a bottom wall 37 having at least one aperture 38 therethrough. The solution chamber 42 includes top wall 43 having at least one vent aperture 44, a side wall 45 having at least one aperture 46 therethrough, and a closed bottom wall 48. An annular passageway 36 is formed between side walls 35 and 45 of the housing 32 and the solution chamber 42, respectively. The side wall aperture 46 is located at distance from the bottom of the chamber 42 of from 0 to 2½ inches, preferably from about ½ to about 1½ inches, most preferably about 1 inch. Above about 2½ inches from the bottom wall 48, the dispensed volume, i.e., the volume of the chamber above the aperture 46, is small, and the resulting dosage amount of solution dispensed is insufficient to provide effective cleaning It is noted that this limitation arises in view of the limitation in dispenser dimensions, which are subject to the dimensions of an overflow tube for a conventional toilet tank. Although the aperture 46 may be provided in the bottom wall of the chamber 42, this is not desirable because fluid flow between the chamber and the housing could be blocked by particles of cleaning vehicle. As more clearly shown in FIG. 3, the solution chamber 42 may be retained within the housing 32 by means of brackets 54 which extend radially from side wall 45 of the solution chamber 42 and onto the edge 39 of the housing 32. Accordingly, solution chamber 42 may be removable and replaceable with a fresh cartridge after the solid cleaning composition vehicle is spent. Alternately, the device 30 may be designed for unitary construction of the housing 32 and the chamber 42. In removable chamber 42 construction, radial ribs may be provided in the passageway 36 to ensure vertical alignment of the housing 32 and the chamber 42. If desired, flexible radial ribs extending outwardly of the housing 32 may be provided to ensure alignment of the device 30 within the overflow tube 25, said ribs being resiliently adapted for reception within overflow tubes of varying diameters.

The dimensions of the device 30 are such that it fits easily within a standard sized overflow tube and with sufficient clearance between side wall 35 and the overflow tube 25 sidewall to allow water from the auxiliary water inlet conduit to pass, as hereinafter described. Accordingly, the outside diameter of the device 30 is between about ½ to about ¾ inch and is about 5 to about 8 inches high. The chamber 42 has an outside diameter of from about ⅜ to about ⅝ inch and is about 5 to about 8 inches high, and has a total volumetric capacity of between about 10 to about 40 ml. Preferably, the dimensions of the housing 32 and the chamber 42 are at a maximum, subject to the constraints of the overflow tube dimensions for the typical models of toilets.

The lower portion of the chamber 42 below the aperture 46 contains the solid cleaning vehicle which may include a disinfectant, a surfactant cleanser, or a compatible combination thereof. The cleaning vehicle is characterized by a solubility that ensures a reasonable length of life of the subject device, typically from about 15 to 45 days based on an average of about 6–15 flushes/day. Suitable disinfectants include calcium hypochlorite, trichloroisocyanuric acid, alone or in combination with isocyanuric acid as a stabilizer, chloramines, chlorinated hydantoins, and the like. Suitable surfactants include among the anionic surfactants alkyl sulfates, alkylaryl sulfates, and alkylaryl sulfonates, and among the nonionic surfactants ethoxylated alkyl phenols and ethoxylated primary and secondary alcohols. The preferred disinfectant is trichloroisocyanuric acid, most preferably in combination with about 5 to about 35% isocyanuric acid. The cleaning vehicle may be provided in any convenient form, as for example a tablet, a cast block, an extrudate, and the like. The solid cleaner vehicle 60 is typically cylindrical in configuration and has a diameter slightly less than to the inside diameter of the chamber 42. A screen or other partition may be included to limit movement of the vehicle 60 with the chamber 42, such as screen 58 provided above the vehicle 60 to prevent its floatation during filling of the chamber 42. The length of the vehicle 60 may vary, bearing in mind that the volume of the chamber 42 occupied by the vehicle 60 reduces for new dispensing units the chamber 42 volume available for forming the cleaning solution. Vehicle 60 length of from about ¾ to about 2 inches are suitable preferably being about 1 to 1½ inches. Preferably, the dispensed volume, e.g., the volume of the chamber 42 above the aperture 46, is between about 15 to about 40 ml, most preferably 20 to about 30 ml. It is further contemplated that the chamber 42 may comprise two separate chambers for containing two incompatible cleaning vehicles, each such separate chamber including a side wall aperture and each being vented to ambient.

In use the device 30 is retained within the overflow tube 25 so that the auxiliary water inlet line 19 empties into the top opening 33 of the housing 32. The housing 32, including the annular passageway 36 between sidewalls 35, 45, fills rapidly, the overflow therefrom flowing into the overflow conduit 25 to the drainpipe 17. As illustrated in FIG. 2 the edge 39 of the housing 32 is below rim 26 of the overflow tube 25 so that the overflow runs into the tube 25 and not over the rim 26. Where the aperture 46 is above the bottom of the chamber 42, residual concentrated solution is present in the chamber 42 as a result of the previous flush. Gradually water in housing 32 enters the cleaning vehicle solution chamber 42 through apertures 46, the chamber 42 filling to a level about equal to the edge 39 of the housing 32. Air is vented through aperture 44. Preferably, the chamber 42 extends above edge 39 and above rim 26 to ensure that liquid does not escape through aperture 44. A portion of the solid cleaning vehicle 60 dissolves in the water added to the chamber 42 to provide a relatively concentrated solution of said vehicle.

During the valve open period, water continues to enter the device 30 and overflow the edge 39 of the housing 32. Water further exits the device 30 through aperture 38 in the bottom of the housing 32. Cleaning vehicle solution, however, remains within the chamber 42. Accordingly, the cleaning solution is not prematurely dispensed to the bowl only to be either greatly diluted or lost to the disposal system.

After the auxiliary water flow ends, water in the housing 32 flows through the aperture 38, and when the level drops toward the apertures 46, cleaning solution discharge commences from the chamber 42, substantially all of which is retained within the bowl water.

A further advantage of the dispenser disclosed herein is improved control over the dissolution of the cleaning vehicle. Thus, the water initially entering the device 30 and which is added to the chamber 42 is the residual water within the water inlet pipe 12 and proximate to the valve 14. At least for a large portion of uses of the device wherein there has been a period of time between flushes, the water added to the chamber 42 will have achieved a moderation of temperature as compared to the temperature of the incoming water source, e.g., the city water supply or well. Fluctuations in water temperature in the solution chamber 42 should be avoided since the solubility of the cleaner active will be affected thereby. Since dispensers for commercial sale are designed based on a mean water temperature, a dispenser is preferred that is adapted to utilize, to the extent possible, in the formation of the cleaning solution water proximate the mean temperature.

Figure 5:
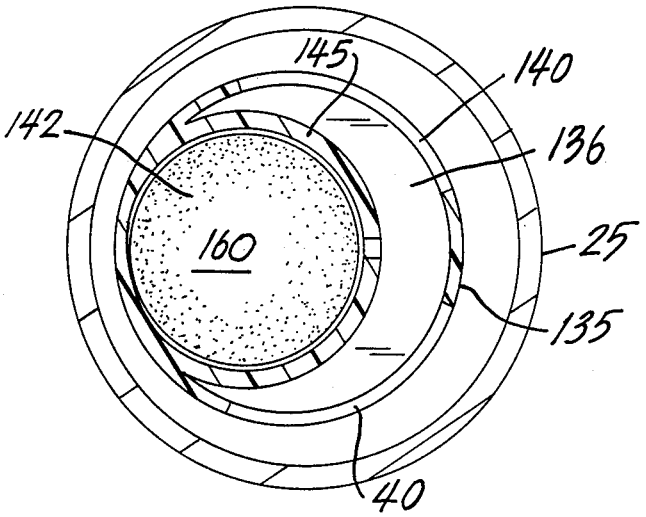
FIG. 5 is a cross-sectional view of the device of FIG. 4 taken along the line 5—5 thereof.
Figure 4:
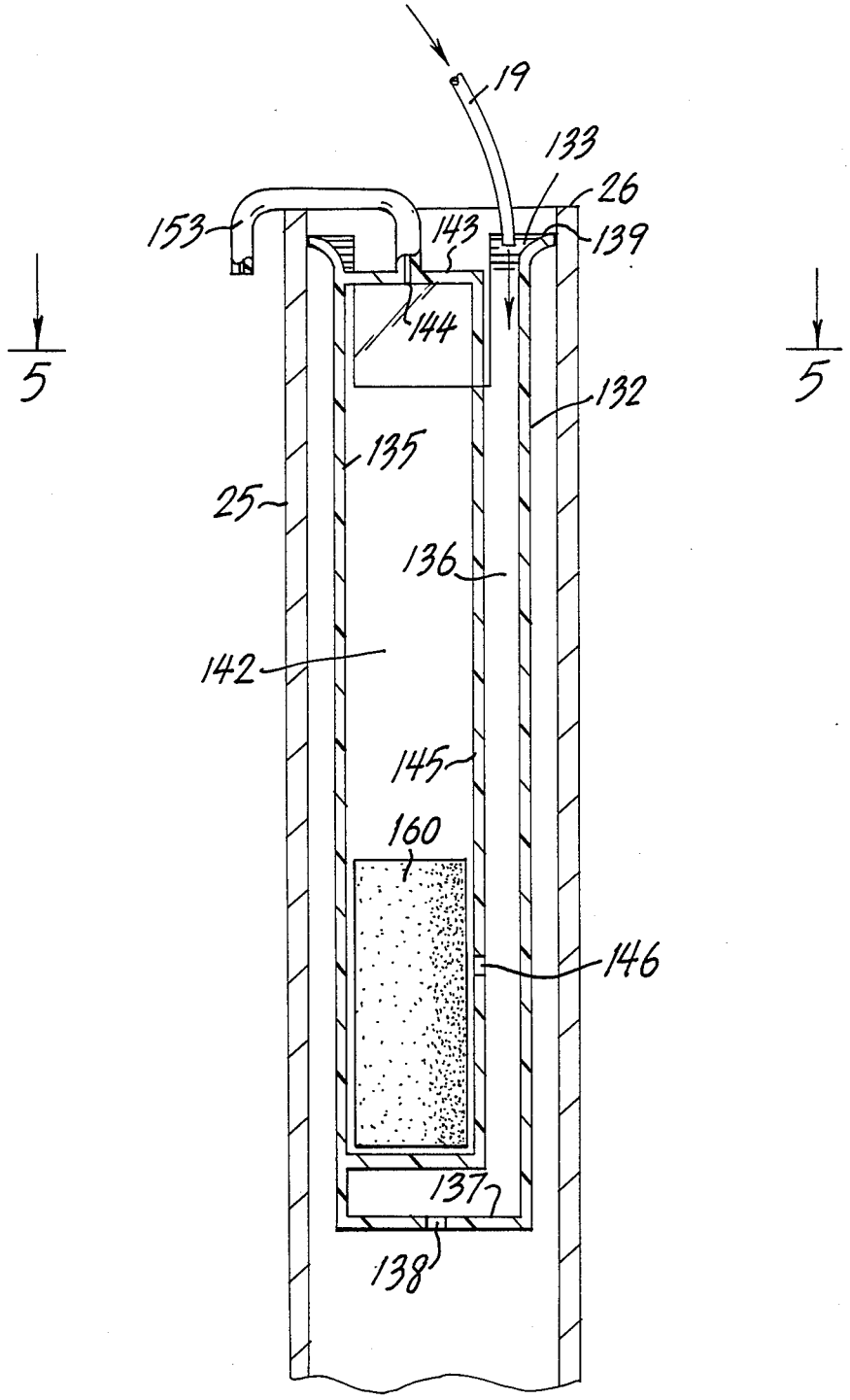
FIG. 4 is a half-sectional view of another embodiment of the device of the present invention as same is installed within the overflow tube.

An alternate embodiment 130 of the dispenser of the present invention is shown in FIGS. 4 and 5. The dispenser 130 comprises an exterior housing 132, an interior chamber 142, and means 153 in the form of an inverted U-shaped vent tube extending from the top of the chamber 142 for suspending the device 130 from the overflow tube 25 The open top 133 includes an outwardly flanged edge 139, which may either overlie the edge 26 of the overflow tube 25 or may abut the side wall of overflow tube 25, in which case the flanged edge 139 is recessed below the edge 26. One or more slots 140 depend from the flanged edge 139 so that water entering the housing 132 can overflow to the overflow tube 25 as shown in FIGS. 4 and 5. The solution chamber 142 is unitary with the housing 132, an arcuate portion of side wall 135 being common to said housing and said chamber, as most clearly illustrated in FIG. 5.

I claim:

1. A toilet bowl cleaning composition dispenser adapted for placement substantially within an overflow tube connecting a toilet tank with a toilet bowl and operative to dispense a dosage amount of an aqueous solution of a cleaning composition subsequent to the cessation of toilet bowl refill water flow through the overflow tube, the dispenser comprising an exterior tubular housing having a top with an opening therein for toilet bowl refill water to enter and said housing having an aperture proximate its bottom for drainage of said water therefrom; a tubular cleaning composition solution chamber within the housing for containing a solid cleaning composition vehicle and said chamber having a top vented to the atmosphere and a bottom; a pathway formed between the housing and the chamber providing fluid communication between the housing opening and the housing aperture, said chamber having an aperture providing fluid communication between the chamber and the pathway, and means to retain the dispenser within the overflow tube.

2. The dispenser of claim 1 wherein the chamber aperture is not greater than 2½ inches from the bottom of the chamber.

3. The dispenser of claim 2 wherein the dosage amount of the solution dispensed is from about 15 to about 40 ml.

4. The dispenser of claim 1 wherein the chamber aperture is from about ½ to about 1½ inches above the bottom of the chamber.

5. The dispenser of claim 4 wherein the dosage amount of solution dispensed is from about 20 to 30 ml.

6. The dispenser of claim 1 wherein the chamber aperture is about 1 inch above the bottom of the chamber.

7. The dispenser of claim 6 wherein the dosage amount of solution dispensed is from about 20 to 30 ml.

8. The dispenser of claim 1 wherein the housing aperture is in the bottom of the housing.

9. The dispenser of claim 1 further comprising a solid cleaning vehicle.

10. The dispenser of claim 9 wherein the solid cleaning vehicle is a disinfectant agent.

11. The dispenser of claim 10 wherein the solid cleaning vehicle is trichloroisocyanuric acid.

12. The dispenser of claim 1 wherein the chamber includes a vent tube.

13. The dispenser of claim 1 wherein the dispenser retaining means is a chamber vent tube including an inverted U-shaped section.

14. The dispenser of claim 1 wherein said means to retain the dispenser within the overflow tube comprises a flanged lip adjacent said top opening, said flanged lip having a diameter sufficient to frictionally retain said dispenser against the inside wall of said overflow tube, said housing further having at least one aperture above the chamber aperture to allow water to overflow the housing.

15. The dispenser of claim 1 wherein the retaining means is a hanging member extending away from said top opening of the housing.

16. The dispenser of claim 1 further including attachment means to provide the chamber within the housing.

17. The dispenser of claim 1 wherein the housing and the chamber are integral.

* * * * *